US005990842A

United States Patent [19]

Lo Forti et al.

[11] Patent Number: 5,990,842

[45] Date of Patent: Nov. 23, 1999

[54] ANTENNA WITH SINGLE OR DOUBLE REFLECTORS, WITH SHAPED BEAMS AND LINEAR POLARISATION

[75] Inventors: Raimondo Lo Forti, Guidonia; Gianfranco Ruggerini; Pasquale Capece, both of Rome, all of Italy

[73] Assignees: Space Engineering S.p.A.; Finmeccanica S.p.A., both of Rome, Italy

[21] Appl. No.: 08/815,666

[22] Filed: Mar. 10, 1997

[30] Foreign Application Priority Data

Mar. 13, 1996 [IT] Italy ..... RM96A0164

[51] Int. Cl.[6] ..... H01Q 19/00

[52] U.S. Cl. ..... 343/756; 343/753

[58] Field of Search ..... 343/756, 753, 343/840, 700 MS, 915, 779; 342/373

[56] References Cited

U.S. PATENT DOCUMENTS

| | | | |
|---|---|---|---|
| 3,864,688 | 2/1975 | Hansen et al. | 343/756 |
| 4,010,471 | 3/1977 | Smith | 343/754 |
| 4,425,567 | 1/1984 | Tresselt | 342/373 |
| 4,586,051 | 4/1986 | Saitto et al. | 343/779 |
| 4,604,624 | 8/1986 | Amitay et al. | 343/756 |
| 4,612,550 | 9/1986 | Bruckner et al. | 343/756 |
| 4,814,775 | 3/1989 | Raab et al. | 342/373 |
| 5,206,658 | 4/1993 | Wokurka | 343/753 |
| 5,365,245 | 11/1994 | Ho | 343/840 |
| 5,440,320 | 8/1995 | Lach et al. | 343/915 |
| 5,463,358 | 10/1995 | Dunn et al. | 343/756 |
| 5,581,265 | 12/1996 | Stirland et al. | 343/756 |
| 5,777,582 | 7/1998 | Raab | 343/700 MS |

FOREIGN PATENT DOCUMENTS

| | | |
|---|---|---|
| 0 310 414 | 4/1989 | European Pat. Off. . |
| 0 390 350 | 10/1990 | European Pat. Off. . |
| 0 437 190 | 7/1991 | European Pat. Off. . |

OTHER PUBLICATIONS

E. Orleansky et al., "A Broadband Meanderline Twistreflector for the Inverse Cassegrain Antenna", pp. 185–192, Microwave Journal, vol. 30, No. 10, Oct. 1987.

Te–Kao Wu, "Meander–Line Polarizer for Arbitrary Rotation of Linear Polarization", pp. 199–201, IEEE Microwave and Guided Wave Letters, vol. 4, No. 6, Jun. 1, 1994.

*Primary Examiner*—Don Wong
*Assistant Examiner*—Hoang Nguyen
*Attorney, Agent, or Firm*—Young & Thompson

[57] ABSTRACT

Shaped beam antenna, with single or double reflector, gridded or non-gridded, the shaped beams, which can rotate the polarisation, independent of the polarisation of the feed cluster, for use preferably aboard satellites and in microwave antennas. The antenna includes a reflector (1), one or more polarisers (2), (2*a*), one or more feed clusters (3), (3*a*), microwave circuits (4), (4*a*) to set-up the BFN, input port (5), (5*a*), and connections (C) and (C1).

2 Claims, 2 Drawing Sheets

ANTENNA WITH SINGLE OR DOUBLE REFLECTORS, WITH SHAPED BEAMS AND LINEAR POLARISATION

The invention presented is an antenna with single or double reflectors, linear polarization, shaped beams, which can rotate the polarization "arbitrarily", i.e., independent of the polarization of the generating system. It can be applied, preferably, in the field of telecommunications via satellite and in the scientific field of telecommunications, more specifically in that of microwave antennas.

The most significant aspect of the present invention is that in order to obtain a good shape of the antenna beam, the main reflector/subreflector should be illuminated by a set of rectangular/square feed elements such that the direction of the electrical field on the feed elements' mouths is parallel to the direction of alignment of the feed elements. As will be explained below, this can be obtained only if the polarization is "reoriented" via a polarizer external to the groups of feed elements so as not to vary the distribution of the electrical field on the feed elements mouth.

The objective intended to be achieved with this invention is that of obtaining, with a single antenna of this type, the performance provided by other types of antenna, but not optimally, for example: performance provided by antennas with shaped reflectors, fed by a single feed, with single or double reflector; performance provided by antennas with parabolic reflectors with feed clusters, etc. The present invention provides a greater or equal antenna gain for the same size of the principal reflectors by deploying an antenna configuration which consists of a reduced cluster (for example from 8 to 11 feed elements) of rectangular multi-/single mode horns, and, a parabolic or slightly shaped reflector.

Known solutions which refer to antennas consisting of feeds, rectangular or circular, concern the family (which for convenience we will call family a) of parabolic-reflector antennas, slightly shaped, fed by a set of feed elements, exhibiting a linear polarization, which can be either circular or rectangular. These antennas can use-mono- or multi-mode Beam Forming Networks (BFN). Reference should be made to the following patents of the same Patentee for details on this: No. RM94A 000005 filed on Jan. 7, 1994 with the title: "Multishaped beam direct radiating array antenna" and No. RM94A 000306 filed on May 17, 1994 with the title: "Shaped-beam or scanned beams reflector or lens antenna".

Another family (called for convenience family b) consists of antennas with shaped reflectors fed by one or more feed elements. However, using this solution, it is difficult to realize multimode antennas. Compared with the antennas belonging to family a), the decoupling between the polarization and the feed cluster alignment leads to a real improvement in performance in terms of antenna coverage gain.

The solution presented here arose from the need to obtain antenna gain values similar to those obtained by the shaped reflector fed by a single feed or only a few feeds. In fact, one of the advantages of the antenna of the present invention is the increase in gain which can be obtained compared with other antennas of the same family a) having the same main reflector diameter.

Compared with family b), the performance of the antenna obtained are similar, such as for example the minimum coverage gain, but in this case the advantage is different. As a matter of fact, the invention can be used to realize multimode antenna beams, for example making it possible to use a non-adjacent interleaved channel output multiplexer, with much lower losses, realizing multimode antenna beams by using the same reflector.

Family a) was the first to come and was used for about ten years. It was slowly replaced by family b) because the latter achieves better gain performance with the same diameter of the main reflector and also because the feeds and BFN are lighter. On the down side, family b) has some disadvantages, some of which are difficulty in reconfiguring the antenna, i.e., changing the beam shape on command, and difficulty in obtaining simultaneous multiple beams. This invention therefore, as mentioned above, aims at improving the type of antenna belonging to family a) in terms of gain, increasing it to the values similar to those of family b) while, however, maintaining the most interesting characteristics of family a).

More specifically, the invention encompasses, in a single solution, the advantages and properties of the two families of antennas indicated here as a) and b). Furthermore, the antenna of the present invention can provide a better result (in the version currently preferred by the inventor) if it consists of the following elements: mono-/multimode BFN, and/or reconfigurable array, i.e., an array which can configure all or part of BFN, rectangular/square feed(s), which, in addition to being rectangular/square, are arranged in the "most appropriate manner" to obtain the desired antenna pattern, the feeds are typically excited by the fundamental mode, plus other higher modes, for example, $Te_n$,O where n=1, 2 . . . 5, polarization rotator, parabolic or slightly shaped reflector, and possibly ellipsoid, hyperbolic or shaped subreflector. The reflector can also be gridded.

The expression "most appropriate manner" refers to the orientation of the cluster of feed elements in accordance with the orientation of the coverage. The orientation is chosen independently of the polarization as the presence of the external polarization rotator allows one to align the polarization independently of the alignment of the feed cluster.

The invention is now described, by way of illustration and not limitation, reference being made to the attached drawings and on the basis of the version of the invention currently preferred by the inventors in which.

Figure 1:
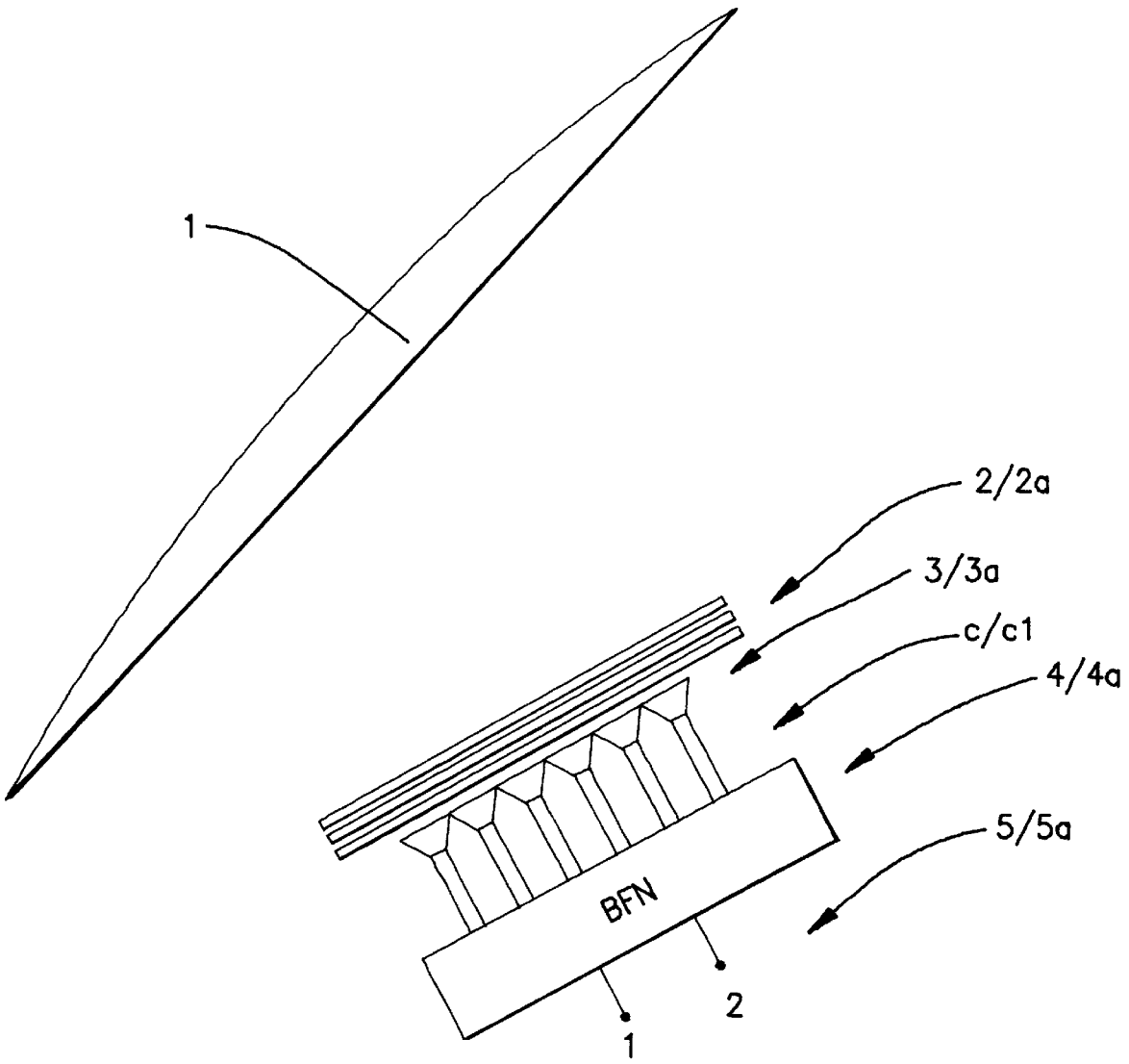
FIG. 1 is a schematic illustration of an embodiment of the present invention.

With reference now to FIG. 1, the antenna layout may include reflector (1), one or more polarizers (2), **(2*a*), one or more feed clusters (3), (3*a*), microwave circuits (4), (4*a*) for the BFN, input ports (5), (5*a*), and connections (C) and (C1**).

Figure 2:
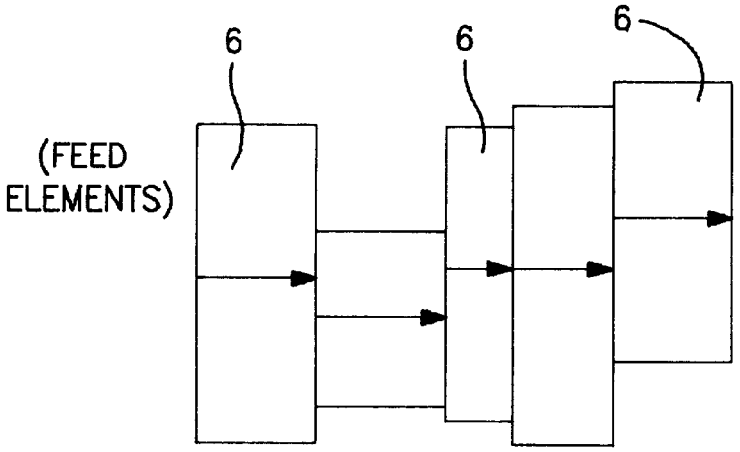
FIG. 2 is a pictorial representation of the feed elements of the present invention.

With reference now to FIG. 2, the invention may include a cluster of rectangular feed elements (6) which are the most efficient system for shaping the antenna beam, on condition that the polarization is parallel with the direction of alignment of the feed elements.

Figure 3:
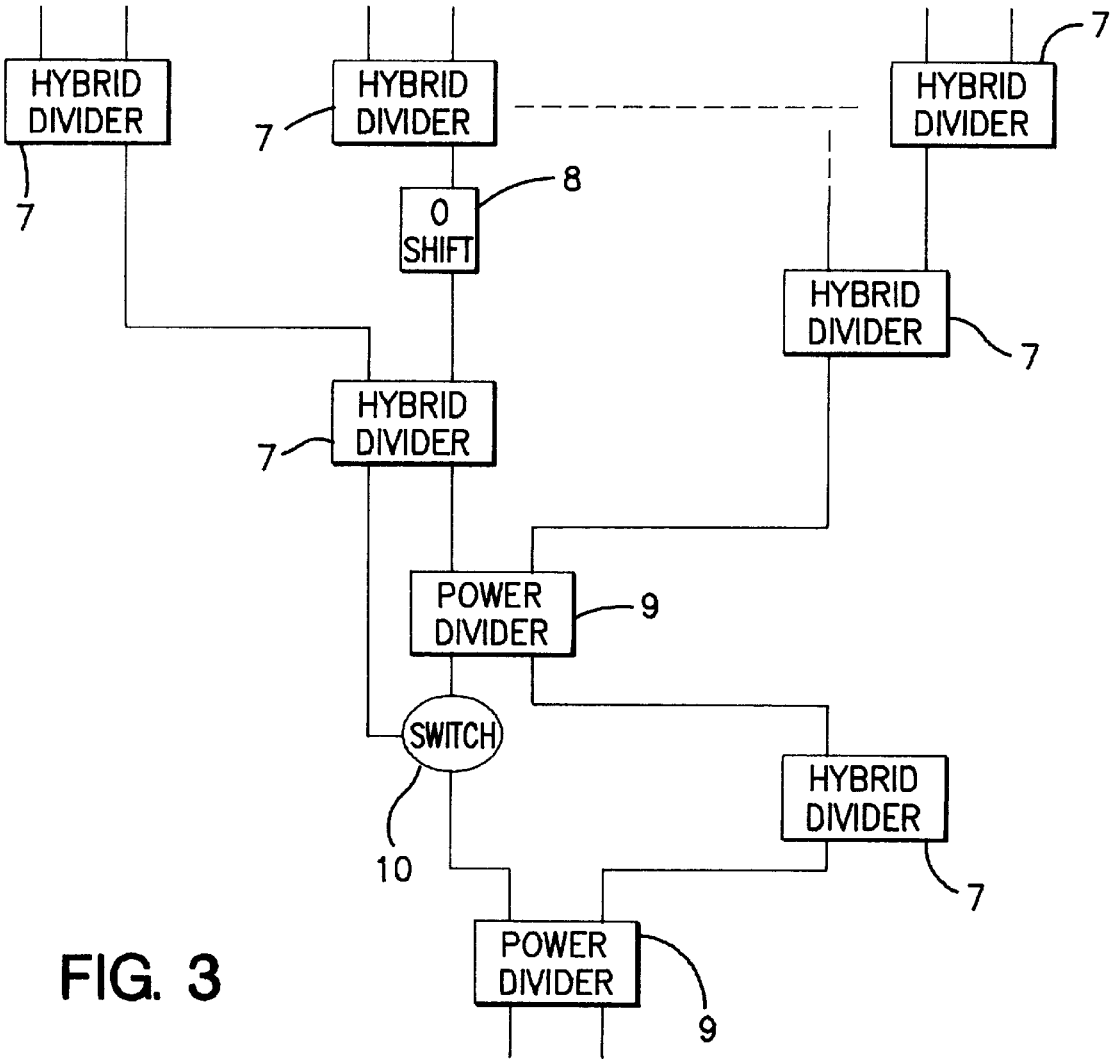
FIG. 3 is a schematic diagram of a microwave circuit.

With reference to FIG. 3, the layout of a typical microwave circuit (BFN) may include, hybrid dividers (7), fixed or variable phase shifters (8), fixed or variable power divider (9), and switch (10).

The BFNs can be either mono- or multimode, and can also be reconfigured by adding to the circuit additional switches, variable power dividers and/or variable phase shifters.

It is important to realize that as the polarization is parallel to the direction of alignment of the feed elements, independent of the antenna's final polarization, it can be reoriented by the polarization rotator external to the feeds cluster.

To improve performance, the antenna of the present invention should consist of:

a mono-/multimode BFN;

one or more rectangular/square feed elements (6) which, in addition to being rectangular/square, are arranged in the most appropriate manner to obtain the desired antenna pattern; and the feed elements which are excited by the fundamental mode or by the fundamental mode plus some higher modes.

We claim:

1. An antenna comprising:

a reconfigurable multimode microwave beam forming network (BFN);

a concave reflector separated from said BFN and providing a shaped beam;

plural rectangular/square feed horn antennas that are arranged in a cluster, connected to said BFN, and aligned to illuminate said reflector to form the shaped beam;

means for exciting said antennas in the fundamental mode and in the fundamental mode plus higher modes; and at least one rotatable polarizer between said feed horn antennas and said reflector and rotating an electric field so that the direction of the electric field is parallel to a direction of alignment of said feed horn antennas and independent of the antenna's final polarization.

2. The antennas of claim 1, wherein said rotatable polarizer comprises at least three grids.

* * * * *